US007713136B1

(12) United States Patent
Colucci

(10) Patent No.: US 7,713,136 B1
(45) Date of Patent: May 11, 2010

(54) ADAPTER WITH RETRACTABLE SPRINGS THAT PICKS UP A GOLF BALL

(76) Inventor: Nicholas Colucci, 67 Bache Ave., New York, NY (US) 10306

( * ) Notice: Subject to any disclaimer, the term of this patent is extended or adjusted under 35 U.S.C. 154(b) by 0 days.

(21) Appl. No.: 12/380,667

(22) Filed: Mar. 3, 2009

(51) Int. Cl.
*A63B 47/02* (2006.01)

(52) U.S. Cl. ..... 473/286; 294/19.2

(58) Field of Classification Search ..... 473/286, 473/282; 294/19.2
See application file for complete search history.

(56) References Cited

U.S. PATENT DOCUMENTS

| | | | | | |
|---|---|---|---|---|---|
| 802,264 | A * | 10/1905 | Brown | 294/19.2 |
| 1,658,145 | A * | 2/1928 | Uyei | 294/19.2 |
| 2,320,611 | A * | 6/1943 | Kandle | 294/100 |
| 2,833,584 | A * | 5/1958 | McEvoy | 294/19.2 |
| 3,318,628 | A * | 5/1967 | White | 294/19.2 |
| 3,698,720 | A * | 10/1972 | Gudmundsen | 473/286 |
| 4,687,204 | A * | 8/1987 | Lempio | 473/286 |
| 5,004,240 | A * | 4/1991 | Tsukamoto | 473/286 |
| 6,171,202 | B1 * | 1/2001 | Schmitt | 473/286 |
| 6,190,265 | B1 * | 2/2001 | Schmitt | 473/286 |
| D477,644 | S * | 7/2003 | Schmitt | D21/721 |
| 7,351,156 | B1 * | 4/2008 | Panneri et al. | 473/132 |
| 7,351,158 | B1 * | 4/2008 | Bronsveld | 473/286 |
| 7,645,200 | B2 * | 1/2010 | Downey | 473/286 |
| 2002/0155897 | A1 * | 10/2002 | Schmitt | 473/286 |
| 2003/0236129 | A1 * | 12/2003 | Pettinga et al. | 473/286 |
| 2008/0064521 | A1 * | 3/2008 | Panneri et al. | 473/282 |
| 2008/0176668 | A1 * | 7/2008 | Downey | 473/286 |
| 2009/0033109 | A1 * | 2/2009 | Lipcznski | 294/19.2 |

* cited by examiner

*Primary Examiner*—Stephen L. Blau

(57) ABSTRACT

An adapter that consist of a cylinder that contains three flat springs shaped to fit around a golf ball and a spring retainer. A golfer can permanently insert the adapter into the butt end of a golf putter shaft without the use of tools. The adapter is comprised of a cylinders with it's out side diameter slightly larger than the inside diameter of the butt end of a putter shaft. When the adapter is inserted into the butt end of a golf putter shaft with the springs positioned in the adapter, the springs will not interfere with the golfer while putting The three flat springs are shaped and spaced slightly smaller than a golf ball when extended to pick up a golf ball. To position the springs to pick up a golf ball, the golfer manually pulls the main spring out of the adapter to a stop that positions the three springs to the proper length to pick up a golf ball. For a golfer to pick up a golf ball, the golfer positions the springs over a golf ball. With pressure down ward over a golf ball the springs will pick up a golf ball. When the process is complete the golfer pushes the springs back into the cylinder for future use.

1 Claim, 1 Drawing Sheet

ADAPTER WITH RETRACTABLE SPRINGS THAT PICKS UP A GOLF BALL

FIELD OF THE INVENTION

The invention relates to an adapter that is permanently inserted into the butt end of a golf putter shaft without the use of tools. Said Adapter is used to pick up a golf ball.

BACKGROUND OF THE INVENTION

There are many people with bending problems. The invention provides a means to pick up a golf ball with an adapter installed in a golf putter shaft. I made an adapter for a friend Vet. that is an amputee. Before I made the attachment for him he had trouble bending to pick up a golf ball. He was very pleased and happy with the adapter I made for him. With the feedback I received from other golfers that saw him pick up a golf ball I decided to apply for a patent.

The majority of golf putter shafts are steel and this adapter can permanently be installed in a standard steel putter shaft without the use of tools. A small size cylinder can be used to insert the Adapter into the butt end of a graphite shaft. The Adapter is a cylinder with three flat springs and a spring retainer in the cylinder. With the adapter installed in a golf putter shaft and the springs positioned in the cylinder the springs will not interfere with a golfer while the golfer is putting.

There are other means to pick up a golf ball out of a golf hole, such as a suction cup that fits over the grip of a putter. This attachment picks up a golf ball. The suction cup attachment interferes with a golfer while putting, the cup don't fit large putter grips, don't pick up small golf balls and is not dependable.

There are attachments that are cumbersome that fit over a golf club head. These adapters don't fit into a golf cup, are easily lost and are troublesome to use. Once my invention is installed into a putter shaft it becomes a permanent part of the putter.

Some putter heads are designed to pick up golf balls. These putter heads don't pick up small golf balls. The putter heads are made small enough to fit into a golf hole and are not large enough for better putting. My invention is an attachment that can be permanently installed into a favorite golf putter shaft.

There is no need to purchase a new putter or tools to install my adapter. Prior art don't provide a self contained adapter that picks up a golf ball with three flat springs, a spring handle and a spring retainer. My adapter can be permanently installed into a putter shaft without tools,

BRIEF SUMMARY OF THE INVENTION

The invention is an adapter that is designed to be permanently installed into the butt end of a golf putter shaft without the use of tools. The adapter consist of two main parts, one a cylinder open at both ends that fits into the butt end of a golf putter shaft. The second part is three flat springs shaped to fit around a golf ball to pick up a golf ball and a steel spring retainer. The three springs are attached to the steel spring retainer and they fit into the cylinder.

With the adapter installed in a golf putter shaft, with the three flat springs positioned in the cylinder, the springs will not interfere with the golfer while putting. The golfer uses the handle of the main spring to manually pull the springs out of the container to a stop. The stop positions the springs to their proper length to pick up a golf ball. For a golfer to pick up a golf ball, the golfer positions the extended springs over a golf ball. With pressure downward over a golf ball the golfer can pick up a golf ball. When the process is complete the golfer uses the handle of the main spring to push the springs back into the cylinder for future use.

DETAILED DESCRIPTION OF THE INVENTION

Figure 1:
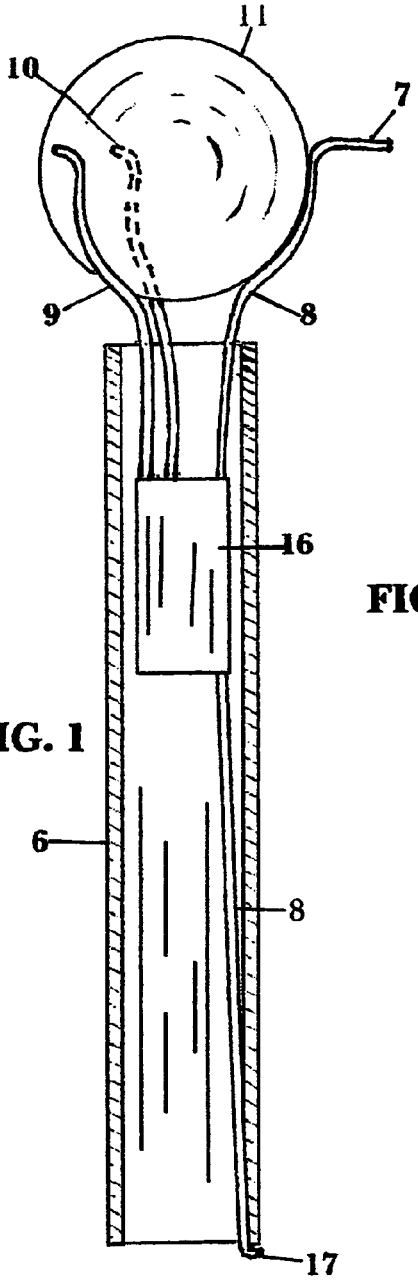
FIG. 1 is a perspective view of the adapter with the springs extended and holding a golf ball. The golf ball is not part of my invention.

FIG. 1 half of the springs are positioned out of the cylinder to hold a golf 11. The golf ball 11 is not part of the invention; it is included in the drawing to show the position and shape of the springs. The main spring 8 is a one piece spring that extends from the handle 7 to the stop 17.

The springs 8, 9 and 10 are attached to the spring retainer 16 and the spring retainer 16 permanently holds the springs 8, 9 and 10 in relation to each other. The handle 7 is to manually pull the springs out or push them into the cylinder. The handle 7 is an extension of the main spring 8. The stop 17 is an extension of the main spring 8.

The stop 17 will position the springs when the main spring 8 is pulled out of the cylinder to pick up a golf ball. The golfer holds spring handle 7 to enable the golfer to pull the main spring 8 out or push the springs into the cylinder. With the adapter installed into the butt end of a golf putter shaft, the golfer pulls the springs out of the cylinder to position the springs 7, 8 and 9 to pick up a golf ball. The bend at the end of the main spring 17 stops the movement of the main spring 8 to position the three springs to pick up a golf ball.

Figure 2:
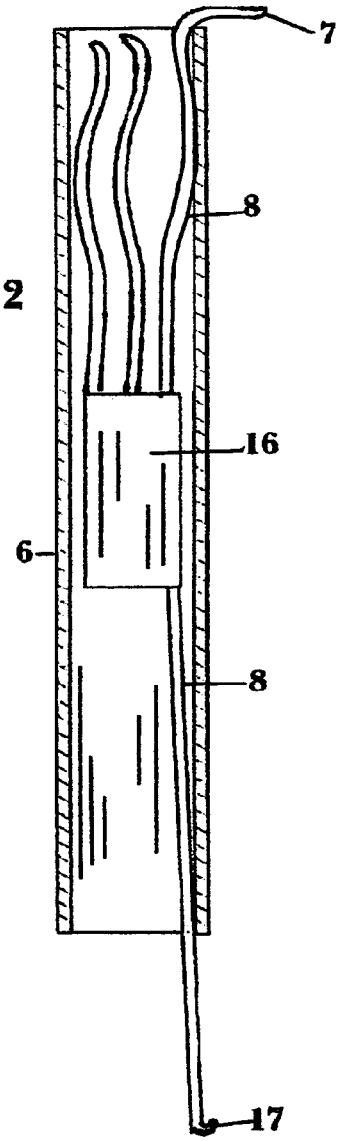
FIG. 2 is a perspective view of the adapter springs contain in the adapter cylinder.

FIG. 2 the springs are in this storage position when not in use. With the adapter installed in the butt end of a golf putter shaft, the springs in this storage position will not interfere with the golfer while putting. The three flat springs 7, 8 and 9 are attached to the steel spring container 16. The steel spring container 16, keeps the three flat springs in relation to each other while the springs are moved to the in or out position.

Figure 3:
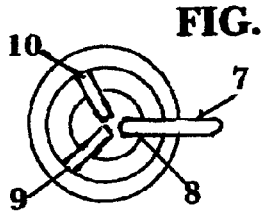
FIG. 3 is a top view of the adapter with the springs contained in the adapter.

FIG. 3 is a top view showing the three flat springs in a storage position. The handle 7 is an extension of the main spring 8 to enable a golfer to hold and to pull the springs 8, 9 and 10 in position for a golfer to pick up a golf ball.

Figure 4:
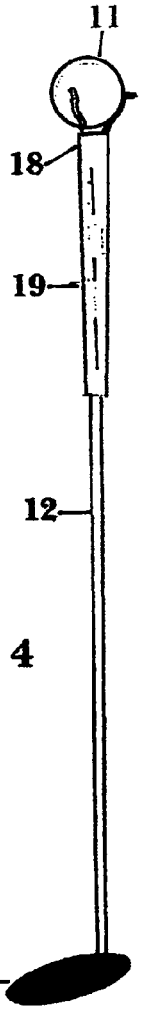
FIG. 4 is a putter with the adapter springs holding a golf ball. The putter and golf ball are not part of my invention.

FIG. 4 is to show a putter with the Adapter holding a golf ball. The putter, putter parts and golf ball 11 are not part of the invention. The butt end 18 of a golf putter shaft The grip of a golf putter 19. The shaft 12 and the putter head 14 are not part of the invention.

The invention claimed is:

1. An adapter that a golfer can permanently install into a butt end of a golf putter shaft without the use of tools, said adapter comprising:

a cylinder open at both ends, one main flat shaped spring with a handle at one end and a stop at an opposite end, two flat shaped supporting springs, the three flat springs are attached to a steel spring retainer;

with said adapter permanently installed in the butt end of a golf putter shaft the three flat shaped springs when extended are shaped and positioned to pick up a golf ball;

said springs are positioned within said cylinder when not in use and extended outside said cylinder when positioned to pick up said ball; and said stop prevents withdrawal of said springs when said springs reach said extended position and wherein said stop is not said retainer.

* * * * *